US008271246B2

(12) United States Patent
Leonard et al.

(10) Patent No.: US 8,271,246 B2
(45) Date of Patent: Sep. 18, 2012

(54) SYSTEM AND METHOD FOR MINIMIZING LOST CIRCULATION

(75) Inventors: Benjamin Ames Leonard, Houston, TX (US); Catalin D. Ivan, West University, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 603 days.

(21) Appl. No.: 12/414,082

(22) Filed: Mar. 30, 2009

(65) Prior Publication Data

US 2010/0250204 A1 Sep. 30, 2010

(51) Int. Cl.
*G06G 7/48* (2006.01)

(52) U.S. Cl. ..... 703/10

(58) Field of Classification Search ..... 703/10; 166/285; 702/11
See application file for complete search history.

(56) References Cited

U.S. PATENT DOCUMENTS

| | | | | |
|---|---|---|---|---|
| 7,499,846 | B2 | 3/2009 | Massingill et al. | |
| 7,950,472 | B2 * | 5/2011 | DiFoggio et al. | 175/38 |
| 2002/0040812 | A1 * | 4/2002 | Heying | 175/72 |
| 2002/0099505 | A1 * | 7/2002 | Thomas et al. | 702/12 |
| 2003/0139916 | A1 * | 7/2003 | Choe et al. | 703/10 |
| 2007/0007006 | A1 * | 1/2007 | Massingill et al. | 166/250.15 |
| 2008/0113879 | A1 | 5/2008 | Way et al. | |

* cited by examiner

*Primary Examiner* — Dwin M Craig
*Assistant Examiner* — Bernard E Cothran
(74) *Attorney, Agent, or Firm* — Carlos L. Hanze

(57) ABSTRACT

A system and method is provided for minimizing lost circulation associated with the operation of a subterranean reservoir. The system includes one or more sources, such as earth modeling and fracture analysis tools, for providing data representative of a fracture formation in the reservoir, and a computer processor in communication with the data sources for determining an appropriate blend of lost circulation material products for application to the fracture formation. The computer processor is programmed with computer readable code for selecting a plurality of candidate products for application to the fracture formation, and for mathematically determining an optimized blend of the selected products. By applying the optimized blend, material and labor costs associated with well operation can be significantly reduced.

20 Claims, 13 Drawing Sheets

100

Lost Circulation Menu

Wellbore Stability Menu

Next to Well Location

- ○ Project Information
- ◉ In-Situ Stress Gradients
- ○ Rock Mechanical Parameters
- ○ Operational Parameters
- ○ Default Fracture Analysis Parameters Set Up Copy In-Situ Stress Gradients

| Parameter | Symbol | Value | |
|---|---|---|---|
| Ratio between $S_H$ and $S_h$ | R | 1.05 | |
| Azimuth of $S_H$ | $S_H$ - Az | 270 | deg |
| Azimuth of $S_h$ | | 360 | deg |

Stress Maps

110

FIG. 4a

100

Lost Circulation Menu

Wellbore Stability Menu

Next to Well Location

- ○ Project Information
- ○ In-Situ Stress Gradients
- ◉ Rock Mechanical Parameters
- ○ Operational Parameters
- ○ Default Fracture Analysis Parameters Set Up Copy Rock Mechanical Parameters

| Parameter | Symbol | Value | |
|---|---|---|---|
| Tensile Strength | $T_o$ | 0 | psi |
| Unconfirmed Compressive Strength | UCS | 3464 | psi |
| Internal Friction Angle | $\phi$ | 30.00 | deg |
| Tectonic Strain | $\varepsilon_{bect}$ | 0 | $x10^{-6}$in./in. |
| Linear Thermal Expansion Coefficient | $\beta$ | 1.00E-05 | $°F^{-1}$ |
| Surface Temperature | $T_s$ | 75 | °F |
| Geothermal Gradient | $G_t$ | 1.7 | °F/100ft |
| Seafloor Temperature | $S_{FT}$ | 40 | °F |

120

FIG. 4b

100

Lost Circulation Menu

Wellbore Stability Menu

Next to Well Location

- ○ Project Information
- ○ In-Situ Stress Gradients
- ○ Rock Mechanical Parameters
- ◉ Operational Parameters
- ○ Default Fracture Analysis Parameters Set Up Copy Operational Parameters

| Parameter | Symbol | Value | |
|---|---|---|---|
| Water Depth | WD | 500 | ft |
| Maximum Equivalent Static Density | ESD | 10.70 | ppg |
| Wellbore ID | $D_W$ | 12.25 | in |
| Maximum Equivalent Circulating Density | ECD | 11.10 | ppg |

130

FIG. 4c

100

Lost Circulation Menu

Wellbore Stability Menu

Next to Well Location

- ○ Project Information
- ○ In-Situ Stress Gradients
- ○ Rock Mechanical Parameters
- ○ Operational Parameters
- ◉ Default Fracture Analysis Parameters Set Up Copy Default Fracture Analysis Parameters

| Parameter | Symbol | Value | |
|---|---|---|---|
| Fracture Height | $H_f$ | 1 | feet |
| Fracture Length | $L_f$ | 6 | inch |
| Fracture Toughness | $K_c$ | 1000 | psi - sqrt(in.) |
| Geometry Factor (PKN) | $\gamma$ | 1.0 | |
| Geometry Factor (KGD) | $\gamma$ | 0.75 | |

140

FIG. 4d

106

Lost Circulation Menu | Stress Distribution Graphs

Back to Analysis Type | Fracture Geometry

Stress Distribution Table | $FBP_D$ Drillability Map

Single Point Analysis

Print Report Copy

| Parameter | | Value | |
|---|---|---|---|
| Overburden Pressure | OB | 8,190 | psi |
| Pore Pressure | P0 | 936 | psi |
| Minimum Horizontal Stress | $S_h$ | 4,045 | psi |
| Maximum Horizontal Stress | $S_H$ | 4,247 | psi |
| Formation Temperature | FT | 185 | °F |
| Temperature Difference | ΔT | 35 | °F |
| Formation Breakdown Pressure - Vertical | $FBP_V$ | 6,360 | psi |
| Formation Breakdown Pressure - Directional | $FBP_O$ | 4,045 | psi |
| Max Wellbore Pressure ( ECD equivalent ) | $P_{Wmax}$ | 5,195 | psi |

180

Verify Losses Condition | High potential of losses!

FIG. 4g

Lost Circulation Menu

Back to Single Point Analysis

Fracture Geometry

◉ Fracture Width

○ Crush Pressure

Copy

108

Fracture Geometry - Dynamic Regime

| | | | |
|---|---|---|---|
| Net Pressure | NP | 1,150 | psi |
| **PKN model** | | | |
| Maximum Fracture Width | $W_{max}$ | 532 | micron |
| Average Fracture Width | $W_{average}$ | 418 | micron |
| **KGD model** | | | |
| Maximum Fracture Width | $W_{max}$ | 532 | micron |
| Average Fracture Width | $W_{average}$ | 313 | micron |
| **Modified KGD model (after Alberty et al)** | | | |
| Maximum Fracture Width | $W_{max}$ | 1,074 | micron |
| Average Fracture Width | $W_{average}$ | 633 | micron |

190

FIG. 4h

Lost Circulation Menu
Back to Fracture Size Chart
LC Product Table

Lost Circulation Material Design

Print Report Copy

Existing Products & Concentration

Are there existing LCM products in the system ◉Yes ○ No Recommendation

202

220

| | Product Name | D50 [μm] | D90 [μm] | Concentration | | Effective |
|---|---|---|---|---|---|---|
| 1 | Check-Loss Fine | 75.0 | 250.0 | 10 | lb / bbl | No |
| 2 | MIL-CARB 150 | 100.0 | 300.0 | 0 | lb / bbl | No |
| 3 | LC-GLIDE | 180.0 | 275.0 | 6 | lb / bbl | No |
| 4 | Mil-Seal Fine | 600.0 | 800.0 | 8 | lb / bbl | Yes |
| 5 | SAFE-CARB 20 | 19.3 | 93.5 | 2 | lb / bbl | No |

Maximum Allowed LCM Concentration in Whole Mud System 40 lb / bbl

Products & Concentration to be Added

230

| | Product Name | D50 [μm] | D90 [μm] | Concentration | | |
|---|---|---|---|---|---|---|
| 1 | No Product Selected | | | | lb / bbl | No |
| 2 | No Product Selected | | | | lb / bbl | No |
| 3 | No Product Selected | | | | lb / bbl | No |

Additional LCM Concentration

FIG. 5b

Back to Product Blend

Lost Circulation Material Design

This table is editable. New products can be added at bottom. Click on column header to sort - click again to reverse order.

Table of Lost Circulation Products

246

| Manufacturer | ProductName | D50 (μ) | D90 (μ) |
|---|---|---|---|
| Halliburton | STEELCASE 50 | 50.000 | 1100.000 |
| Halliburton | STEELCASE 100 | 100.000 | 190.000 |
| Halliburton | STEELCASE 400 | 400.000 | 650.000 |
| Halliburton | STEELCASE 1000 | 1000.000 | 1550.000 |
| Halliburton | STOP-FRAAC D | 10.000 | 120.000 |
| M&D Industries | Ultra Seal C | 592.900 | 844.600 |
| M&D Industries | Ultra Seal XP | 92.200 | 281.200 |
| M-I SWACO | C-SEAL (EMI-738) | 126.800 | 190.800 |
| M-I SWACO | C-SEAL F (EMI-739) | 29.360 | 114.300 |
| M-I SWACO | FORM-A-PLUG II | 45.000 | 150.000 |
| M-I SWACO | FORM-A-SET | 300.000 | 1180.000 |
| M-I SWACO | FORM-A-SET AK | 180.000 | 355.000 |

FIG. 5C

250

PROVIDUS Engineering Tools Software

LCM Product Mixture is NOT Adequate for Fracture Size

OK

FIG. 5d

300

Lost Circulation Menu
Back to Fracture Size Chart
LC Product Table

Lost Circulation Material Design

Print Report Copy

Existing Products & Concentration

Are there existing LCM products in the system ◉Yes ○ No Recommendation

310

| | Product Name | D50 [μm] | D90 [μm] | Concentration | | Effective |
|---|---|---|---|---|---|---|
| 1 | Check-Loss Fine | 75.0 | 250.0 | 10 | lb / bbl | No |
| 2 | MIL-CARB 150 | 180.0 | 380.0 | 8 | lb / bbl | No |
| 3 | LC-GLIDE | 180.0 | 275.0 | 6 | lb / bbl | No |
| 4 | Mil-Seal Fine | 600.0 | 800.0 | 4 | lb / bbl | Yes |
| 5 | SAFE-CARB 20 | 19.3 | 93.5 | 2 | lb / bbl | No |

Maximum Allowed LCM Concentration in Whole Mud System 40 lb / bbl

320

Products & Concentration to be Added

| | Product Name | D50 [μm] | D90 [μm] | Concentration | |
|---|---|---|---|---|---|
| 1 | Walnut Shells Fine | 212.0 | 710.0 | 10 | lb / bbl |
| 2 | No Product Selected | | | | lb / bbl |
| 3 | No Product Selected | | | | lb / bbl |

Additional LCM Concentration 10

FIG. 6a

300

Lost Circulation Menu

Back to Fracture Size Chart

LC Product Table

Lost Circulation Material Design

Print Report Copy

Existing Products & Concentration

Are there existing LCM products in the system ◉Yes ○No Recommendation

330

| | Product Name | D50 [μm] | D90 [μm] | Concentration | | Effective |
|---|---|---|---|---|---|---|
| 1 | Check-Loss Fine | 75.0 | 250.0 | 10 | lb / bbl | No |
| 2 | MIL-CARB 150 | 180.0 | 380.0 | 8 | lb / bbl | No |
| 3 | LC-GLIDE | 180.0 | 275.0 | 6 | lb / bbl | No |
| 4 | Mil-Seal Fine | 600.0 | 800.0 | 4 | lb / bbl | Yes |
| 5 | SAFE-CARB 20 | 19.3 | 93.5 | 2 | lb / bbl | No |

Maximum Allowed LCM Concentration in Whole Mud System 40 lb / bbl

340

Products & Concentration to be Added

| | Product Name | D50 [μm] | D90 [μm] | Concentration | |
|---|---|---|---|---|---|
| 1 | Walnut Shells Fine | 212.0 | 710.0 | 2 | lb / bbl |
| 2 | Chek-Loss Coarse | 150.0 | 425.0 | 8 | lb / bbl |
| 3 | No Product Selected | | | | lb / bbl |

Additional LCM Concentration 10

FIG. 6b

Lost Circulation Menu
Back to Fracture Size Chart
LC Product Table

Lost Circulation Material Design

Print Report Copy

300

Existing Products & Concentration

Are there existing LCM products in the system ◉Yes ○ No Recommendation

350

| | Product Name | D50 [μm] | D90 [μm] | Concentration | | Effective |
|---|---|---|---|---|---|---|
| 1 | Check-Loss Fine | 75.0 | 250.0 | 10 | lb / bbl | Yes |
| 2 | MIL-CARB 150 | 180.0 | 380.0 | 8 | lb / bbl | Yes |
| 3 | LC-GLIDE | 180.0 | 275.0 | 6 | lb / bbl | Yes |
| 4 | Mil-Seal Fine | 600.0 | 800.0 | 4 | lb / bbl | No |
| 5 | SAFE-CARB 20 | 19.3 | 93.5 | 2 | lb / bbl | No |

Maximum Allowed LCM Concentration in Whole Mud System 60 lb / bbl

360

Products & Concentration to be Added

| | Product Name | D50 [μm] | D90 [μm] | Concentration | |
|---|---|---|---|---|---|
| 1 | Walnut Shells Fine | 75.0 | 250.0 | 13 | lb / bbl |
| 2 | Chek-Loss Coarse | 300.0 | 425.0 | 16 | lb / bbl |
| 3 | W.O 30 Coarse | 180.0 | 355.0 | 1 | lb / bbl |

Additional LCM Concentration 30

FIG. 6c

SYSTEM AND METHOD FOR MINIMIZING LOST CIRCULATION

FIELD OF THE INVENTION

The present invention relates generally to a system and method for minimizing lost circulation within subterranean reservoirs, and more particularly, to a system and method for determining a blend of lost circulation materials for application to drilling-induced subterranean fractures.

BACKGROUND OF THE INVENTION

Unintended drilling induced fractures are known to increase operating costs and reduce efficiency of well operations. Fractures can cause well instability, well collapse, stuck drill pipes, costly pipe removal and maintenance, and non-productive well downtime. For example, over a typical one-year period, it is estimated that up to one-third of non-productive time can be attributed to lost circulation caused by unintended fracture formations. In addition, the cost of operating a well may increase significantly due to the need to replace drilling fluid and cement lost into the formation. An inability to properly treat and control such fracture formations may result in reservoir damage due to mud losses, and even the possibility of blow-outs due to inadequate hydrostatic pressures downhole.

To mitigate the effects of unintended fracture formations, so-called "lost circulation materials" are often used to seal or obstruct the fracture formations in subterranean reservoirs. Rig operators, for example, commonly use rough estimates of fracture size distributions and "rules of thumb" based on experience to determine the type, amounts and/or combinations of materials to apply to fractures. Such materials include may include cement, crushed walnuts and other synthetic materials that the operator determines to be appropriate for the well based on that operator's experience with the well.

A major shortcoming, however, is that the determination of the materials to be used is done without taking advantage of abstract rock properties and operational data, such as may be derived by reservoir modelers, to more accurately create an optimal concentrations and amounts of the products to be applied. In practice, operational personnel rarely delve into detailed reservoir modeling data, and regardless, have no tools to use such data to determined optimized blends of lost circulation products to be used. In addition, the range of product options and sizes available to operators are typically limited to those products used or manufactured by vendors or service providers supporting the drilling operations.

As such, a need exists to more effectively treat fracture formations in order to lower operational costs and increase drilling efficiency. In particular, a need exists in a planning phase to combine detailed reservoir modeling data with a robust range of lost circulation material product options in order to derive an optimal fill blend for a specific fracture or set of fractures.

SUMMARY OF THE INVENTION

A system is provided for minimizing lost circulation associated with the operation of a subterranean reservoir. The system includes a computer processor, one or more sources for providing data representative of the fracture formation in the reservoir, and a computer processor in communication with the one or more data sources, the computer processor having computer usable media programmed with computer executable code for determining a optimal blend of lost circulation products. The computer executable code includes a first program code for selecting, in accordance with the data representative of the fracture formation, a plurality of products for obstructing the fracture formation, and a second program code, in communication with the first program code, for mathematically determining an optimized blend of the selected products.

In accordance with another aspect of the invention, a computer-implemented method for minimizing lost circulation associated with the operation of a subterranean reservoir includes the steps of using data representative of the fracture formation to determine physical attributes of the fracture formation, selecting a plurality of products for obstructing the fracture formation, and determining a mathematically optimized blend of the selected products to be applied to the fracture formation. Physical attributes, for example, may include size, depth, orientation and fracturing potential. Based at least in part on the physical attributes, candidate products are selected from a list of available products. Concentrations of the selected products are then determined for application as a blended product to the fracture formation.

In yet another aspect of the invention, a computer program product is provided having computer usable media and computer readable program code embodied therein for using data representative of the fracture formation to determine physical attributes of the fracture formation, selecting a plurality of products for obstructing the fracture formation, and determining a mathematically optimized blend of the selected products to be applied to the fracture formation.

Advantageously, the systems, methods and computer program products of the present invention can be used to select, from a robust list of products, material products to be mixed into a mathematically optimized blend in order to more effectively minimize lost circulation associated with subterranean wells. The system utilizes rock properties, earth model data, and well operational data, to determine optimal concentrations of the selected products. The system can be used for well operation planning purposes so that the most appropriate materials and quantities thereof are made available to operators at the well location. By optimally selecting, blending and applying the materials, amounts of wasted materials can be greatly reduced and well efficiency greatly improved.

BRIEF DESCRIPTION OF THE DRAWINGS

A detailed description of the present invention is made with reference to specific embodiments thereof that are illustrated in the appended drawings. The drawings depict only typical embodiments of the invention and therefore are not to be considered to be limiting of its scope.

FIGS. 4*a-h* show user interfaces representative of a computer-implemented workflow for characterizing a fracture formation in accordance with the present invention;

FIGS. 5*a-d* show user interfaces representative of a computer-implemented workflow for selecting a candidate list of products for minimizing lost circulation; and FIGS. 6*a-c* show user interfaces representative of a computer-implemented workflow for mathematically optimizing a blend of selected products for minimizing lost circulation.

DETAILED DESCRIPTION

Figure 1:
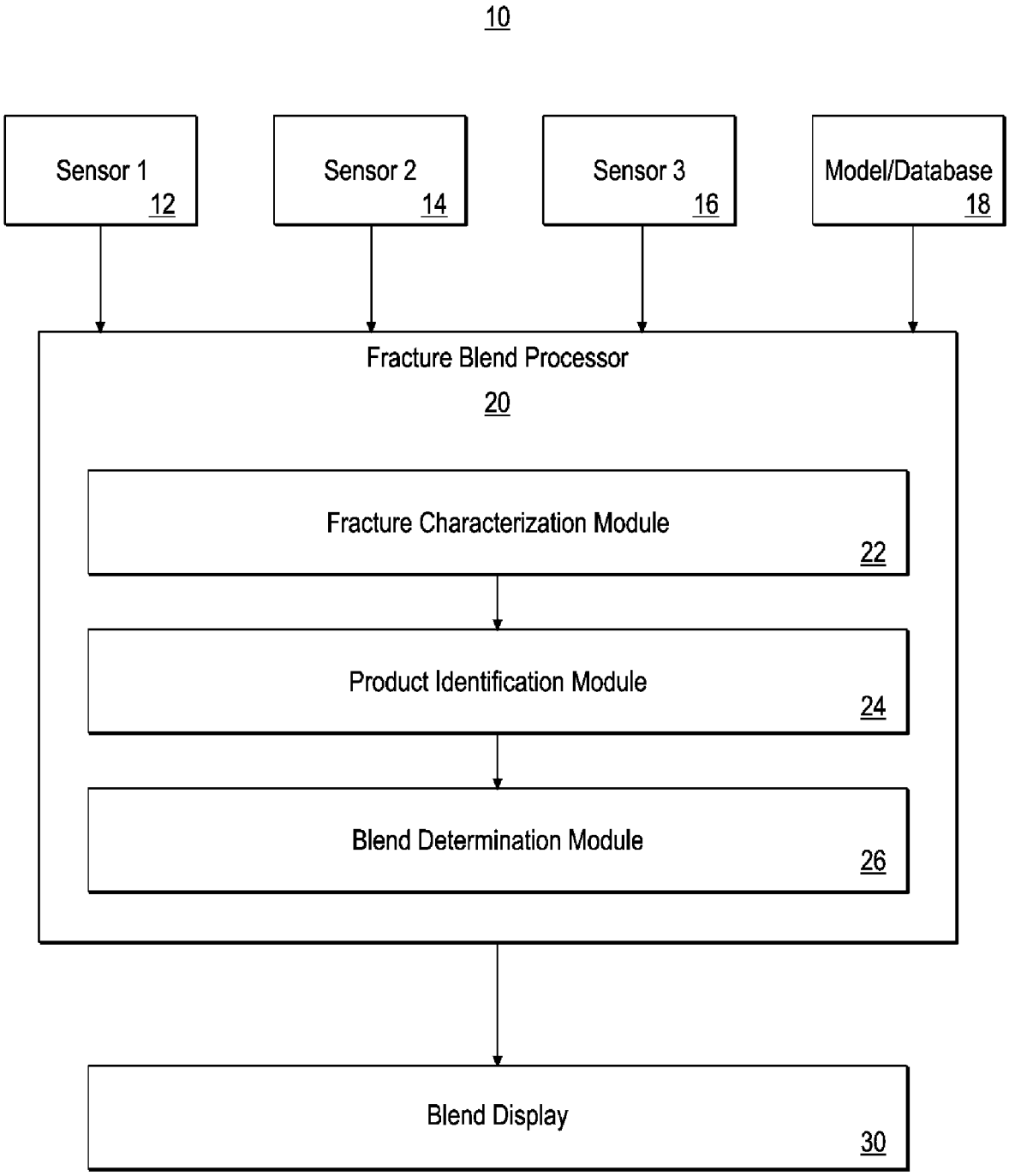
FIG. 1 shows a block diagram of a system for minimizing lost circulation in accordance with a first aspect of the present invention.

The present invention may be described and implemented in the general context of instructions to be executed by a computer. Such computer-executable instructions may include programs, routines, objects, components, data structures, and computer software technologies that can be used to perform particular tasks and process abstract data types. Software implementations of the present invention may be coded in different languages for application in a variety of computing platforms and environments. It will be appreciated that the scope and underlying principles of the present invention are not limited to any particular computer software technology.

Moreover, those skilled in the art will appreciate that the present invention may be practiced using any one or combination of computer processing system configurations, including but not limited to single and multi-processer systems, hand-held devices, programmable consumer electronics, mini-computers, mainframe computers, and the like. The invention may also be practiced in distributed computing environments where tasks are performed by servers or other processing devices that are linked through a one or more data communications network. In a distributed computing environment, program modules may be located in both local and remote computer storage media including memory storage devices.

Also, an article of manufacture for use with a computer processor, such as a CD, pre-recorded disk or other equivalent devices, could include a computer program storage media and program means recorded thereon for directing the computer processor to facilitate the implementation and practice of the present invention. Such devices and articles of manufacture also fall within the spirit and scope of the present invention.

Referring now to the drawings, embodiments of the present invention will be described. The invention can be implemented in numerous ways, including for example as a system (including a computer processing system), a method (including a computer implemented method), an apparatus, a computer readable media, a computer program product, a graphical user interface, a web portal, or a data structure tangibly fixed in a computer readable memory. Several embodiments of the present invention are discussed below. The appended drawings illustrate only typical embodiments of the present invention and therefore are not to be considered limiting of its scope and breadth.

FIG. 1 is a block diagram representation of a system 10 for minimizing lost circulation in accordance with the present invention. The system 10 includes one or one or more sources 12-18 for providing data representative of the fracture formation in the reservoir. The data sources may include one or more sensors or devices 12-16 in communication with a computer processor 20 for gathering data characteristic of fracture formations of a well, and also earth modeling tool or database 18 for generating or providing earth model data. Data sources for example may also include well operators or earth modeling personnel charged with providing fracture-related data via one or more graphical user interfaces in communication with the computer processor 20. The computer processor 20 includes a computer executable program code 22-26 for using the fracture data to determine an optimized blend of products for application to the fracture formations, and a graphical user interface or equivalent device 30 for displaying details on the optimized product blend to a rig operator or planner. Blend details may include concentrations of the various products to be used in the optimized blend, and instructions for creating the blend. Optionally, the system 10 may be used to generate instructions to control the operation of one or more devices (not shown) for measuring and/or mixing the selected products into the optimized blend.

Figure 2:
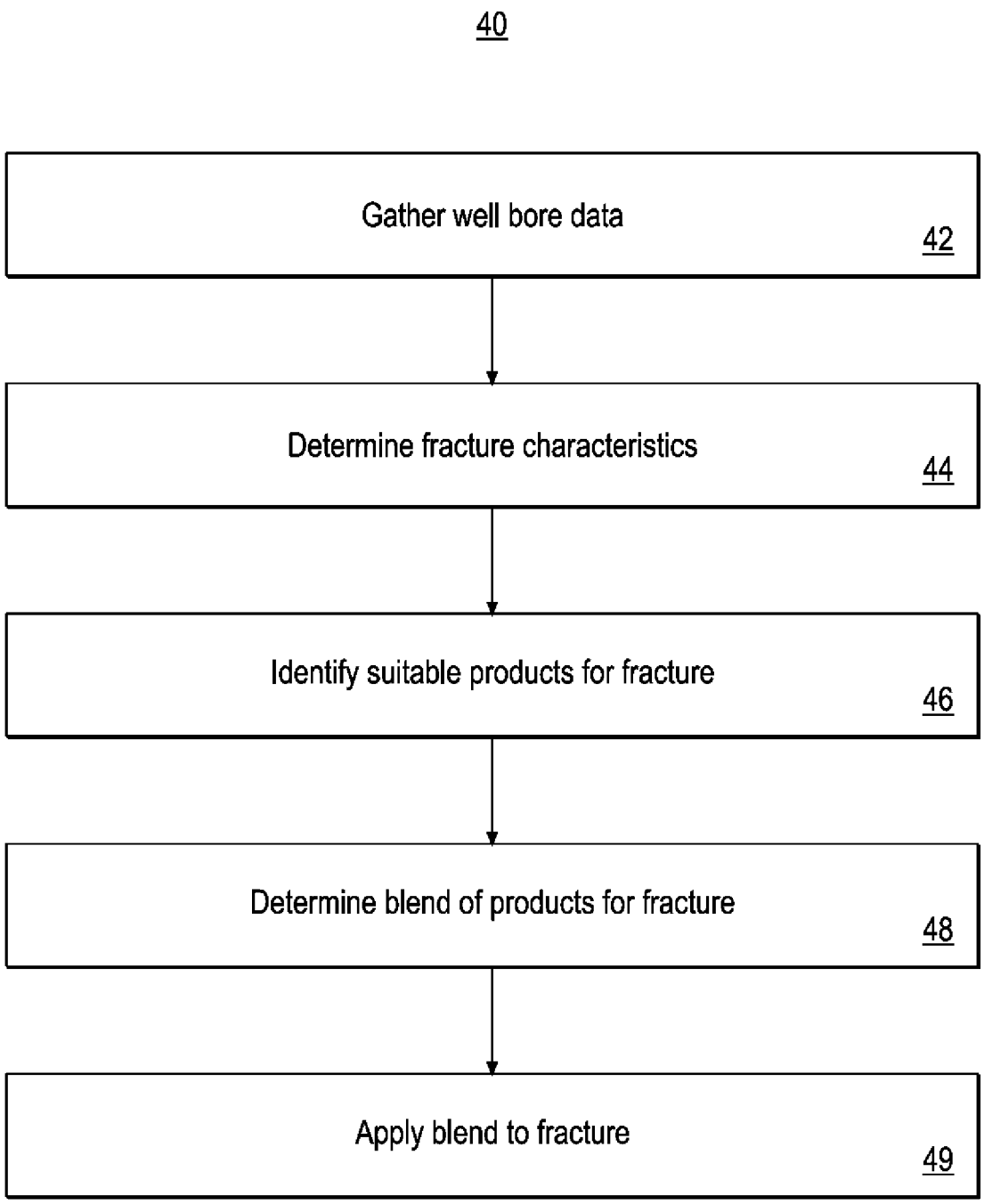
FIG. 2 shows a flow diagram for a method for minimizing lost circulation in accordance with a second aspect of the present invention.

In accordance with another aspect of the present invention, the computer executable code 20 is designed and configured to implement the method 40 shown in FIG. 2. The method 40 includes the steps of gathering well bore data representative of a fracture formation, such as shear data, pressure data, mud/water flow rates, fluid density, depth of well, inclination of well, and other well log and well operational data, etc., as may be appreciated by one with skill in the art, Step 42, and using the well bore data to conduct a fracture analysis to determine physical characteristics of the fracture formation, Step 44. Method 20 further includes using the fracture analysis to identify products or materials that may be suitable for use in the characterized fracture, Step 46, determining an optimized blend of the identified product, Step 48, and applying the optimized blend to the fracture, Step 49. Although shown as having fracture characterization module 22, product identification module 24, and blend optimization module 26, the executable code 20 can be segmented or distributed as appropriate to the execute the method 40.

Figure 3:
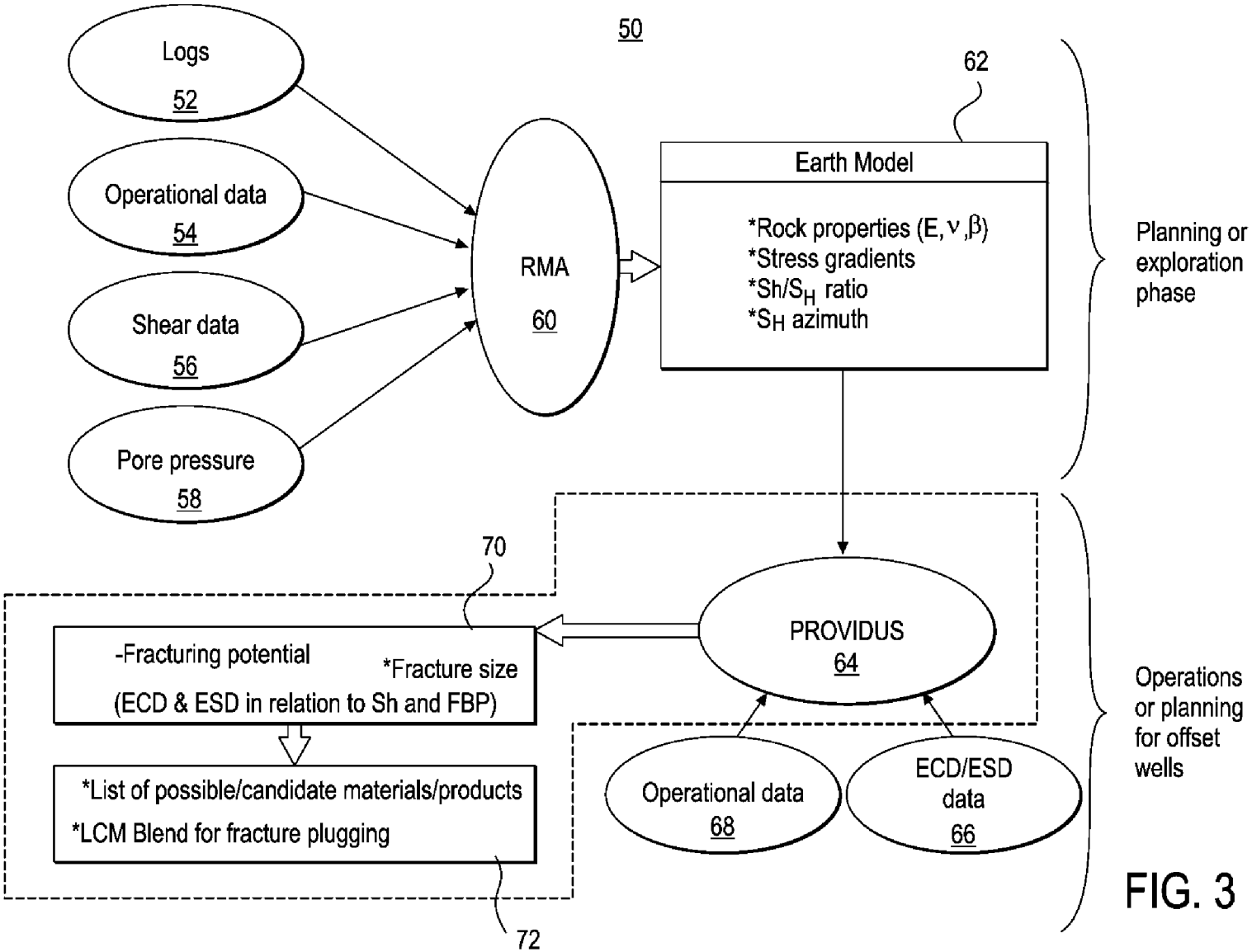
FIG. 3 shows a block diagram of another embodiment of the system in accordance with present invention.

The software can be distributed, for example, as shown in FIG. 3, which shows a PROVIDUS system 50 having software modules 64, 70, 72 for estimating wellbore pressures that will initiate formation fracturing, estimating size distribution of the fractures for a given over-pressure, generating a list of vendor products that will be suitable for treating the fractures, and given a selection of vendor products, calculating the optimal blend of the selected products.

Steps 42 and 44 can be performed via a fracture characterization module 22, as shown in FIG. 1, with input from sensors 12-16 or earth model 18. Alternatively, as shown in FIG. 3, well logs 52, operational data 54, shear data 56 and pressure data 58 are provided to rock mechanics analysis RMA tool 60, or equivalent earth modeling tool or tools, to generate earth model data 62 such as rock properties, stress gradients, $S_h/S_H$ ratio and $S_H$ azimuth. Operational data 54 may include general well information and parameters, including but not limited to well depth, hole size, and fluid properties. Earth model data 62 is then combined with ECD/ESD data 66 and additional operational data 68, e.g., well bore pressures, specific to the drilling operation via PROVIDUS module 64. PROVIDUS module 70 then uses the earth modeling information 62 and data 66 and 68 to predict whether or not fractures will form, and if so, what size they will be. The predicted fracture size information is then used by module 72 to determine which lost circulation material (LCM) products will help to impede fluid from flowing into the fracture and what the optimal blend of different LCM products would be.

In one embodiment of the present invention, the PROVIDUS system performs a fracture analysis using algorithms and methods known and appreciated by those with skill in the art. Fracture analysis data may include mechanical properties of the rock/formation in question, earth stresses ($S_v$, $S_H$, and $S_h$), well depth, well orientation, drilling fluid temperature, and minimum and maximum pressures that the formation is exposed to (ESD and ECD respectively). Using methods known and appreciated in the art, PROVIDUS estimates wellbore pressures that will initiate formation fracturing, and size distribution of the fractures for a given over-pressure. PROVIDUS then uses the fracture data, along with stored product data, including data about products already in the fracture, to mathematically determine an optimized blend to be applied to the fracture.

Alternatively, earth model data 62 and fracture analysis data 70 can be provided to module 72 manually via an operator or automatically via a database or other data storage device in communication with module 72.

Figure 4E:
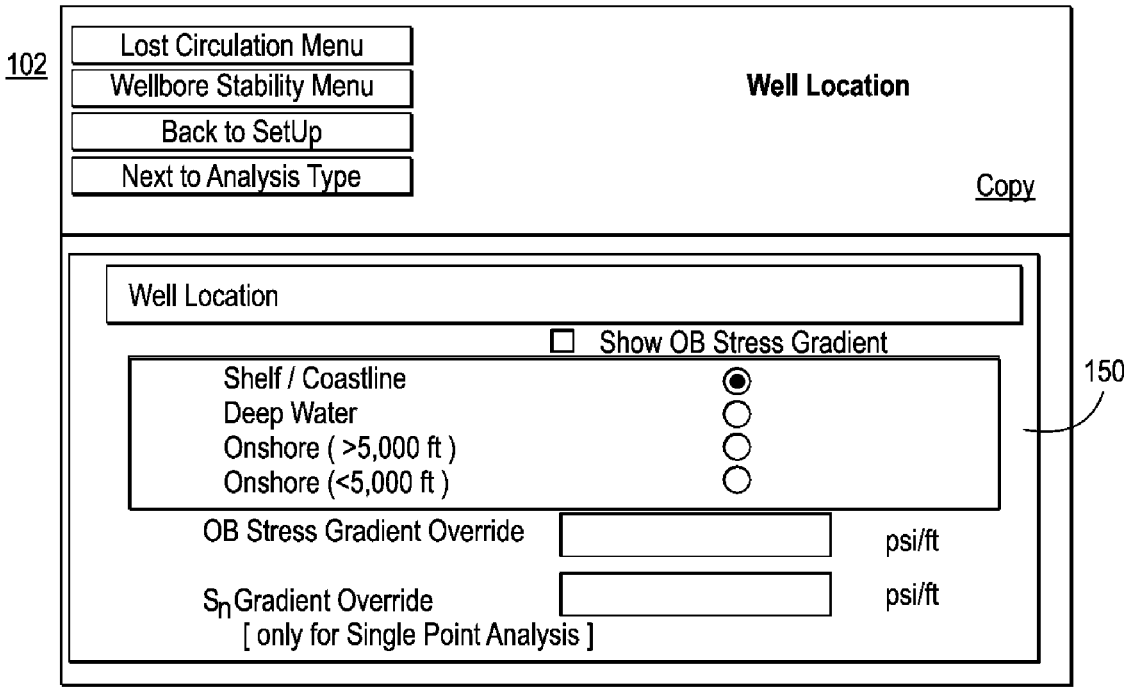

Steps 42 and 44 can also be performed as shown in FIGS. 4*a-h*, which show exemplary user interfaces representative of a workflow for characterizing a fracture formation in accordance with the present invention. Using set-up menu options 100 as shown in FIG. 4*a*, a user enters or downloads from a database certain "In-Situ Stress Gradients" parameters 110, including the ratio between maximum and minimum horizontal earth stress, $S_h/S_H$, and respective orientations, $S_h$ azimuth and $S_H$ azimuth. The user then selects "Rock Mechanical Parameters" 120 as shown in FIG. 4*b* to enter or download general rock and earth properties. Some of these parameters are defaults, others maybe a result of a rock mechanics study by a third party.

Alternatively, the software can provide suggestions for many standard rock types and locations if no other information is available. Rock mechanical parameters may include one or more of the following: tensile strength, unconfined compressive strength, internal friction angle, tectonic strain, linear thermal expansion coefficient, surface temperature, geothermal gradient, and seafloor temperature.

Next, as shown in FIG. 4*c*, the operator chooses "Operational Parameters" 130 to enter or download well operational data, the most important being maximum equivalent static density (ESD) and equivalent circulating density (ECD). These parameters are used to determine if and by how much the formation rock fractures. Other operational parameters may include water depth and wellbore ID. The user then uses the interface of FIG. 4*d* to provide final general inputs 140 having an impact on fracture calculations. These inputs may include fracture height, fracture length, fracture toughness, geometry factor (PKN), and geometry factor (KGO).

Figure 4F:
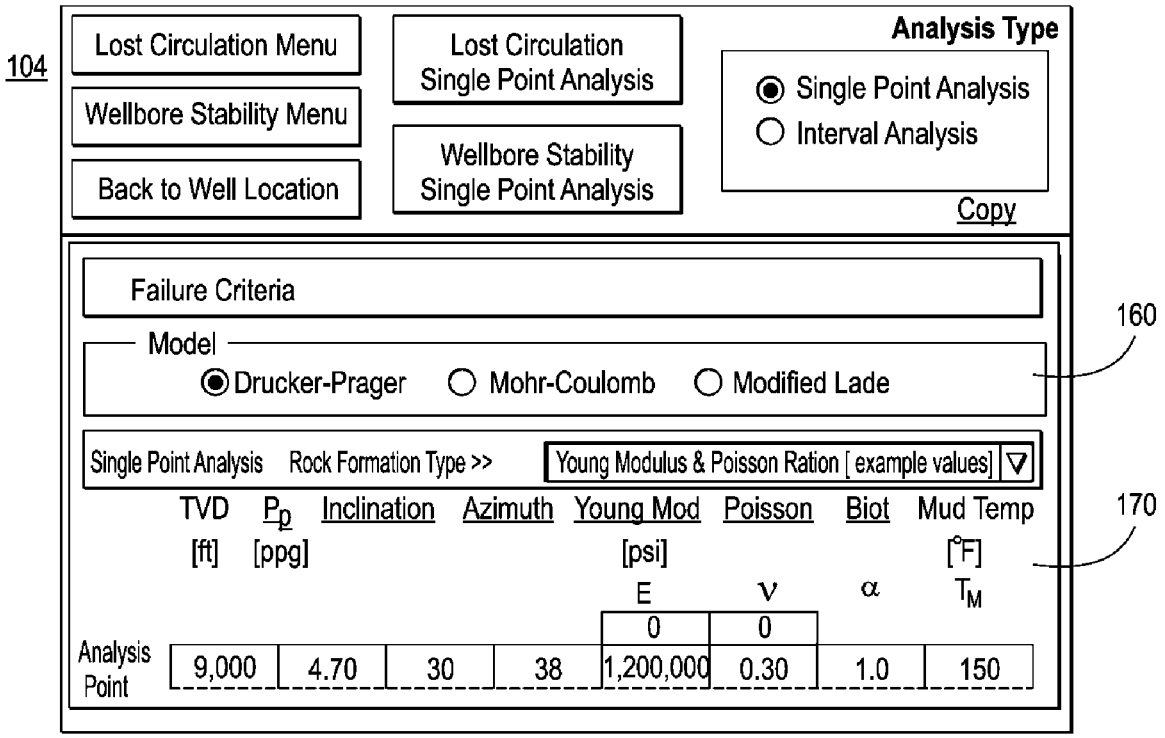

The operator then uses interface 102 as shown in FIG. 4*e* to provide well location and water depth, if any. These parameters 150 are used to estimate pressures applied to the subject rock. The user is able to override these calculations and directly enter values from another source, if desired. Interface 104 as shown in FIG. 4*f* is then used to enter the type of fracture analysis to be performed, e.g., single point analysis or interval analysis, failure criteria 160, and parameters 170 such as the depth of the well, the local pore pressure, the angle and direction of the well, and local rock properties. With this data, the program can calculate the conditions under which a fracture formation would fail.

FIG. 4*g* shows the results of the fracture single point analysis 106, which in this example shows that rock failure is predicted 180. This means that fractures will open in the rock surrounding the wellbore and that drilling fluid will flow into these fractures. This flow, or so-called "losses," can cause drilling problems, damage to equipment, well down-time, and increased expenses associated with replacement of the lost fluid. FIG. 4*h* shows additional fracture analysis details 108, including predicted fracture average and maximum size 190, from which the fracture size distribution is based. The fracture analysis, as well as the remaining steps of the present method, can be used in for example in a "troubleshooting" or real-time mode to diagnose existing problems on a rig, or in a planning, predictive or prognostic mode to model potential problems that may be experienced and materials that may be required at a given drilling site.

Referring again to FIG. 2, Step 46 can be performed via product identification module 24 as shown in FIG. 1 (reference numeral 72 in FIG. 3) to automatically select a set of "candidate" products for application to the fracture. With the fracture data, product identification module 24, as may be embodied in PROVIDUS module 64, vets a comprehensive list of vendor products and generates a list from which the user selects the products to be used. The candidate products are selected from the comprehensive list based on predetermined criteria, including size distribution. The use of the comprehensive list is advantageous over conventional methods since the range of available products is usually limited to those products sold or used by vendors contracted to service and/or operate the drilling location.

Figure 5A:
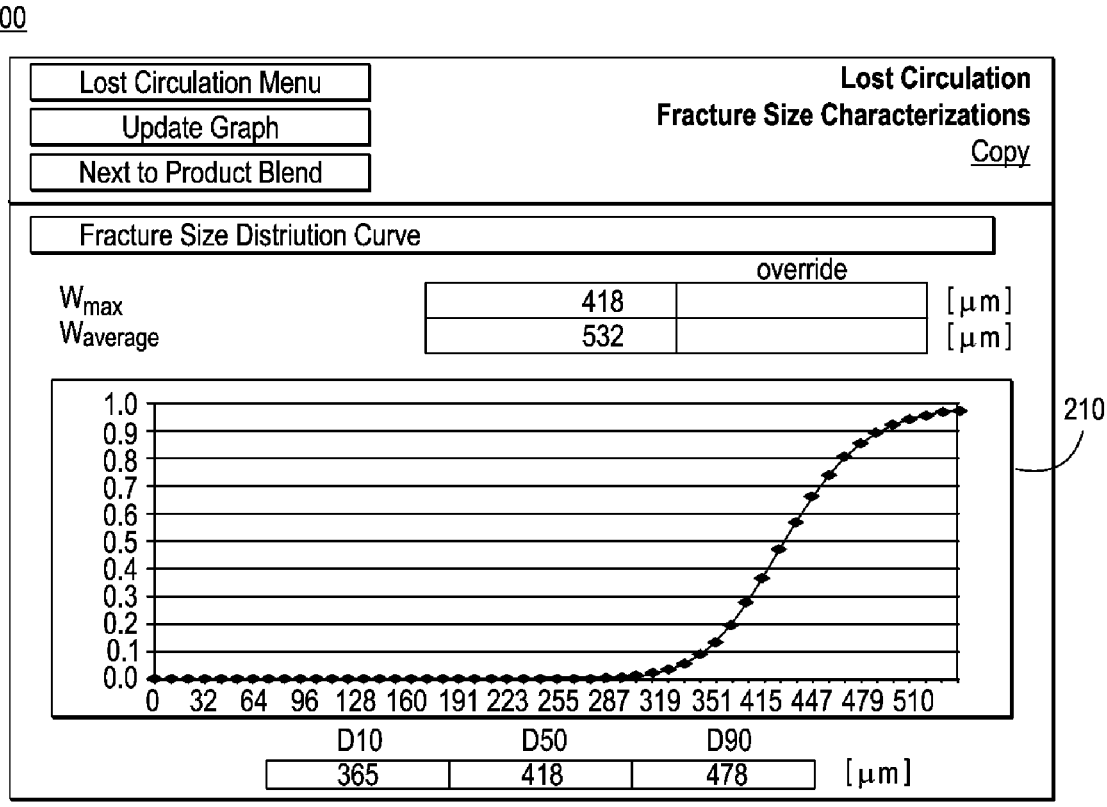

FIGS. 5*a-d* show user interfaces representative of a workflow for selecting a candidate list of products for minimizing lost circulation. Initially, as shown in the interface 200 FIG. 5*a*, the user loads the fracture size distribution 210 from the previous portion of the program. The user can override the sizes and manually input the distribution if they know what it is. The user interface 202 of FIG. 5*b* is then provided for selecting a list of candidate materials or products 220/230 from a lost circulation materials design list 204 of FIG. 5*c*. The product list 204 is extensive and covers the entire product line 240 of every major fluids vendor. The operator first evaluates products already in the drilling fluid that may satisfy the fracture size distribution of FIG. 5*a*, and may enter as many as five existing products. The program then evaluates whether the products are of an appropriate size in accordance with Equation (1) below:

$$\text{Fracture } D50 \leqq \text{Product } D90 \text{ and Product } D90 \leqq 2\times \text{Fracture } D90 \quad \text{(Eq. 1)}$$

If the product meets these criteria, then it is judged effective. The program goes further to evaluate if the total concentration of acceptable products is sufficient to stop the fluid losses into the formation. In performing the concentration evaluation, the program uses a predetermined minimum threshold amount, for example 8 pounds per barrel (lb/bbl), of effective bridging material required to stem the fluid losses. If a user selects a product, for example by clicking on a recommend button, and the concentration threshold is not satisfied, then the operator is notified via the pop-up window 250 of FIG. 5*d* that the LCM product is not adequate for the fracture size.

Referring again to FIG. 2, Step 48 can be performed using the workflow illustrated with reference to FIGS. 6*a-c*. FIGS. 6*a-c* show user interfaces representative of a workflow for optimizing a blend of selected products for minimizing lost circulation. Using these interfaces 300, 310/330/350 and 320/340/360, the user selects what additional products they wish to add and enters a maximum allowed concentration. This is usually a limitation of the fluid properties or downhole tools. In a preferred embodiment, the user may add one (FIG. 6*a* 320), two (FIG. 6*b*340), or three additional products(FIG. 6*c* 360), but additional products may be included. The objective is to determine the optimal blend of products for application to the fracture so as to best bridge, fill, plug or otherwise obstruct the characterized fracture. The products can be selected based on the effectiveness criteria previously stated, which narrows the list from a hundred to a few dozen in most cases. This is to help the user apply products that will actually work, and not to apply products downhole which will not assist in reducing losses and/or exacerbate the problem.

In the case of a single additional product, as shown in FIG. 6*a*, the amount of the product recommended to add is determined by Equation 2:

$$C_1 = \text{Max.Allowed Concentration} - \Sigma\text{Existing Product Concentrations} \quad \text{(Eq. 2)}$$

where $C_1$ is the concentration of product 1.

In the case of two additional products, as shown in FIG. 6*b*, the mix is found by solving Equations 3 and 4 to ensure that the total additional product concentration matches the maximum allowable concentration minus the sum of the existing concentrations and that that weighted average of the two additional products D90 size matches that of the fracture D90.

$$C_1+C_2=\text{Max.Allowed Concentration}-\Sigma\text{Existing Product Concentrations}\ D90_1C_1+D90_2C_2=D90_{Fracture}\times(C_1+C_2) \quad \text{(Eqs. 3 \& 4)}$$

This set of linear equations is solve through the Ax=b formula. Where A is the matrix on the left hand side of the equation, x is the solution vector, and b is the constants vector on the right hand side. This requires the equation to take the form of $x=A^{-1}b$, which requires matrix inversion and then multiplication. This process is the same for two or three products.

If a third product is included, as shown in FIG. 6*c*, the total concentration must still be calculated as before, the D90s match, and now the D50s must be matched as well in accordance with Equations 5-7:

$$C_1+C_2+C_3=\text{Max.Allowed Concentration}-\Sigma\text{Existing Product Concentrations}$$

$$D90_1C_1+D90_2C_2+D90_3C_3=D90_{Fracture}\times(C_1+C_2+C_3)$$

$$D50_1C_1+D50_2C_2+D50_3C_3=D50_{Fracture}\times(C_1+C_2+C_3) \quad \text{(Eqs. 5, 6, 7)}$$

The result of these Equations 5-7 is the concentration of products that the field personnel need to add to the fluid system to minimize losses.

As such, the system, method and computer product of the present invention are advantageous in that they include, in an integrated fashion, the steps of fracture modeling, lost circulation material product selection, and product blending.

Other embodiments of the present invention and its individual components will become readily apparent to those skilled in the art from the foregoing detailed description. As will be realized, the invention is capable of other and different embodiments, and its several details are capable of modifications in various obvious respects, all without departing from the spirit and the scope of the present invention. Accordingly, the drawings and detailed description are to be regarded as illustrative in nature and not as restrictive. It is therefore not intended that the invention be limited except as indicated by the appended claims.

What is claimed is:

1. A system for selecting lost circulation materials associated with the operation of a subterranean reservoir, the reservoir having a fracture formation contributing to lost circulation, the system comprising:

one or more sources for providing data representative of the fracture formation in the reservoir; and a computer processor in communication with the one or more data sources, the computer processor comprising computer usable media programmed with computer executable code, the computer executable code comprising:

a first program code for selecting, in accordance with the data representative of the fracture formation, a plurality of lost circulation products from a list of available lost circulation materials; and a second program code, in communication with the first program code, for determining an optimized blend of the selected lost circulation products for application to the fracture formation, and wherein the optimized blend is based on a comparison of statistical distributions of selected lost circulation product size and fracture formation size.

2. The system of claim 1, further comprising a third program code in communication with the second program code for generating display data associated with the optimized blend.

3. The system of claim 1, further comprising a device for displaying details of the optimized blend.

4. The system of claim 1, wherein the one or more data sources comprises an earth model.

5. The system of claim 1, wherein the one or more data sources comprises fracture analysis means.

6. The system of claim 1, wherein the one or more data sources comprises one or more sensors for detecting data characteristic of the fracture formation.

7. The system of claim 1, wherein the one or more data sources comprises one or more graphical user interfaces for entry of fracture related data.

8. The system of claim 1, wherein the one or more data sources comprises one or more databases in communication with the computer processor, wherein the one or more databases include data characteristic of the fracture data.

9. The system of claim 1, further comprising a fourth program code in communication with the second program code for controlling application of the optimized blend.

10. The system of claim 1, further comprising a fifth program code in communication with the second program code for controlling a blending device for producing the optimized blend.

11. The system of claim 1, wherein the second program code evaluates if a total concentration of selected lost circulation products is sufficient to stop fluid losses into the fracture formation.

12. The system of claim 1, wherein the second program code evaluates the use of an additional lost circulation product in the optimized blend based on a difference between a maximum allowed concentration of all lost circulation products, and a total concentration of all existing lost circulation products already applied to the fracture formation.

13. The system of claim 1, wherein the second program code evaluates the use of additional lost circulation products in the optimized blend based on a solution of a set of linear equations relating to (a) concentrations of each additional lost circulation product, (b) a maximum allowed concentration of all lost circulation products, (c) a total concentration of all existing lost circulation products already applied to the fracture formation, (d) the statistical distributions of the additional lost circulation product sizes, and (e) the statistical distributions of the fracture formation size.

14. A computer-implemented method for selecting lost circulation materials associated with the operation of a subterranean reservoir, the reservoir having a fracture formation contributing to lost circulation, the method comprising:

using data representative of the fracture formation to determine physical attributes of the fracture formation, the physical attributes comprising a fracture formation size;

selecting a plurality of lost circulation products from a list of available lost circulation materials; and mathematically determining an optimized blend of the selected lost circulation products to be applied to the fracture formation, and wherein the determining step comprises comparing statistical distributions of selected lost circulation product size and fracture formation size.

15. The method of claim 14, further comprising the step of mixing the optimized blend in accordance with computed concentrations of the selected lost circulation products.

16. The method of claim 14, further comprising the step of applying the optimized blend to the fracture formation.

17. The method of claim 14, further comprising evaluating if a total concentration of selected lost circulation products is sufficient to stop fluid losses into the fracture formation.

18. The method of claim 14, further comprising evaluating the use of an additional lost circulation product in the optimized blend based on a difference between a maximum allowed concentration of all lost circulation products, and a total concentration of all existing lost circulation products already applied to the fracture formation.

19. The method of claim 14, further comprising the use of additional lost circulation products in the optimized blend based on a solution of a set of linear equations relating (a) concentrations of each additional lost circulation product, (b) a maximum allowed concentration of all lost circulation products, (c) a total concentration of all existing lost circulation products already applied to the fracture formation, (d) the statistical distributions of the additional lost circulation product sizes, and (e) the statistical distributions of the fracture formation size.

20. A non-transitory computer-readable storage medium having computer readable program code embodied therein, the computer readable program code adapted to be executed to implement a method for selecting lost circulation materials associated with the operation of a subterranean reservoir, the method comprising:

using data representative of a fracture formation to determine physical attributes of the fracture formation, the physical attributes comprising a fracture formation size;

selecting a plurality of lost circulation products from a list of available lost circulation materials; and mathematically determining an optimized blend of the selected lost circulation products to be applied to the fracture formation, and wherein the determining step comprises comparing statistical distributions of selected lost circulation product size and fracture formation size.

* * * * *